United States Patent [19]

Hays

[11] 3,948,301

[45] Apr. 6, 1976

[54] BAMMER

[76] Inventor: Lela Mae Hays, P.O. Box 1091, Central Valley, Calif. 96019

[22] Filed: Mar. 5, 1973

[21] Appl. No.: 338,087

[52] U.S. Cl. ..... 145/29 R; 145/29 A; 145/36

[51] Int. Cl.[2] ..... B25D 1/00

[58] Field of Search .... 145/29 R, 29 A, 29 B, 29 C, 145/29 D, 30.5, 30, 36; 173/90; 254/26

[56] References Cited

UNITED STATES PATENTS

| | | | |
|---|---|---|---|
| 83,228 | 10/1868 | Warne | 145/29 B |
| 103,706 | 5/1870 | Bidwell | 145/36 |
| 495,607 | 4/1893 | Barney | 145/36 |
| 579,287 | 3/1897 | Wylly | 145/29 R |
| 2,043,442 | 6/1936 | McNeil | 145/29 A |
| 2,776,689 | 1/1957 | Falzone | 145/29 A |
| 3,019,827 | 2/1962 | Jeffery et al. | 145/36 |
| 3,088,506 | 5/1963 | Bianchini | 145/36 |
| 3,253,329 | 5/1966 | Lehn | 145/29 B |
| 3,303,863 | 2/1967 | Titchnell | 145/29 R |
| 3,343,576 | 9/1967 | Norcross | 145/36 |

FOREIGN PATENTS OR APPLICATIONS

| | | | |
|---|---|---|---|
| 225,938 | 2/1959 | Australia | 145/29 B |

*Primary Examiner*—Al Lawrence Smith
*Assistant Examiner*—J. T. Zatarga

[57] ABSTRACT

A novel innovation which expands the uses of a basic tool (hammer) is the major function of the present invention's design, as disclosed.

Specifically the Bammer, which utilizes a principle of inertia to concentrate and compound the initial striking force, allows the user the means to work in small or cramped enclosures, and to successfully accomplish tasks which would be difficult, if not impossible with conventional tools of a similar nature.

3 Claims, 4 Drawing Figures

BAMMER

OBJECT OF THE PRESENT INVENTION

The present invention, as disclosed herein, was designed to fulfill a recognised need which is experienced by carpenters, cabinet makers, and hobby craftsmen — the object of the invention is to provide a hammer-like tool which embodies a range of varied uses, and utilizes the inertia principle to furnish a supplemental force to the usual striking force of a hammer stroke.

DETAILED DESCRIPTION

Figure 3:
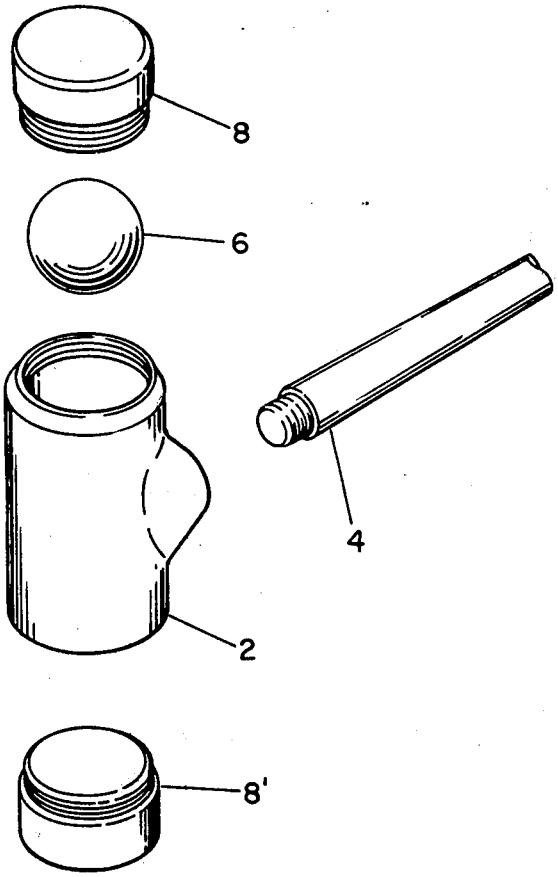
FIG. 3 is a three-dimensional disassembly view of the device.
Figure 4:
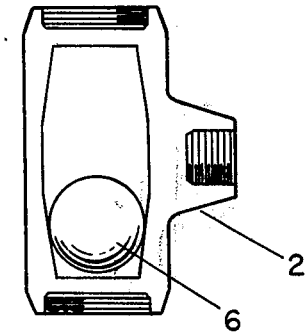
FIG. 4 is an orthographic view of the head of the device.

As illustrated in FIG. 3, the basic components of the device are as follows: The head (2) is joined to the handle shaft (4) by a threaded portion of the handle shaft, allowing the interchanging of handles. The construction of the head assembly, as shown in FIG. 4, includes a hollow body with the cavity tapered at both ends to allow a positive seat for the movable ball (6), and threaded openings at either end, to accept the interchangable heads (8 and 8').

Figure 1:
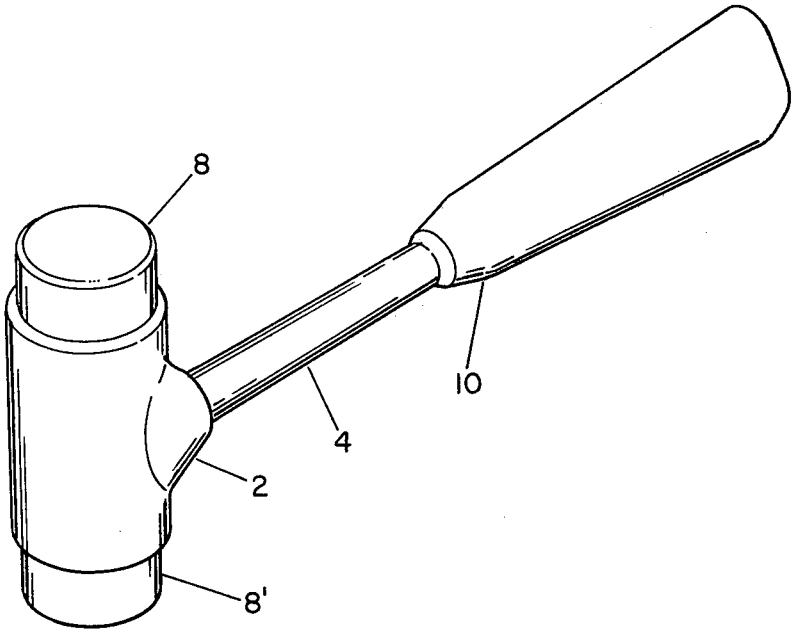
FIG. 1 is a three-dimensional view of the basic device as assembled in accordance with the present invention. waste
Figure 2:
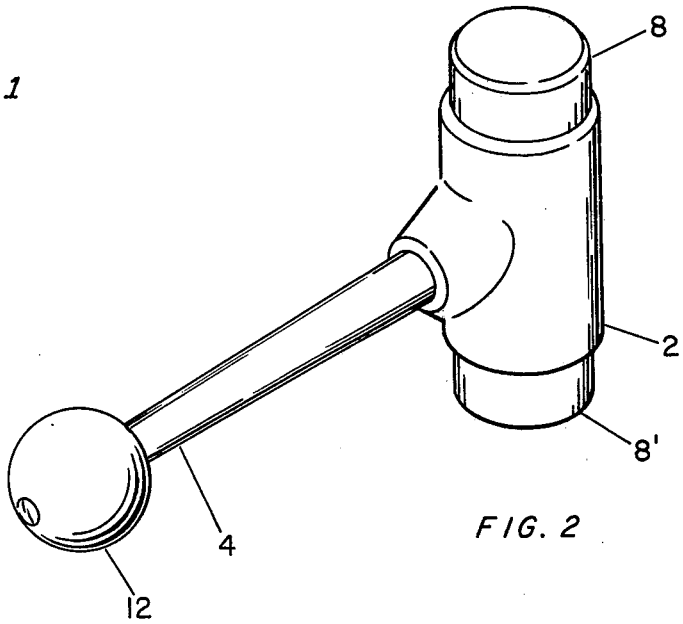
FIG. 2 is a three-dimensional view of a variation of the basic device.

FIG. 1 shows the basic tool fitted with a conventional handle, (10), while FIG. 2 illustrates the device with a shorter, ball-grip handle (12) for use in extremely limited work spaces.

As indicated previously, a wider range of uses is possible with the device, as the interchangable heads may include rawhide, plastic, rubber or lead inserts as well as the ordinary steel heads, to accomodate a variety of tasks.

What is claimed for the invention is:

1. A hammer type device comprising an open ended integrally formed cylindrical body member having a bore extending longitudinally therethrough and opening out of both ends thereof, a socket formed integrally with the body member intermediate the ends thereof and projecting radially outwardly therefrom, said socket having an internally threaded cylindrical recess defined therein and extending outwardly therefrom, said opposite ends of said bore each being internally threaded, a steel ball having a diameter slightly less than the diameter of said bore and adapted to be placed in said bore for free unhindered reciprocal movement between opposite ends of said bore, a pair of identical elongated cylindrically shaped head members each having a head portion of a diameter greater than the bore and a shank portion extending axially outwardly of said head portion and having thread portions thereabout time determined a size gated pitch adapted to be threadedly received in an associated end of said bore, each head member associated with one end of said bore and threadedly received thereon to retain said ball member inwardly of said bore, the threaded shank portion of each head member received in said bore with the head portion of each head member engaging an associated end of said housing, and an elongated shaft having a handle member disposed on one end thereof with the opposite end being of a reduced diameter than circuit diameter of the shaft and having screw type threads formed thereabout, said threaded end of said shaft adapted to threadedly engage said threaded recess of said socket to detachably attach said shaft to said body member, and said handle member adapted to be grasped in a hand of an individual to impart a hammer like motion to the device.

2. The hammer type device as set forth in claim 2 wherein said handle member on said shaft is comprised of a spherical ball grip member affixed to said shaft.

3. The hammer type device as set forth in claim 2 wherein said handle member on said shaft is comprised of an elongated gripping member having a bore extending therethrough and opening out of one end thereof and adapted to receive said associated end of said shaft therein for retaining said gripping member to said shaft to serve as a handle member therefor.

* * * * *